United States Patent [19]

Propst

[11] Patent Number: 5,069,466

[45] Date of Patent: Dec. 3, 1991

[54] CART ASSEMBLY

[76] Inventor: Robert L. Propst, 18845 NE. 49th Pl., Redmond, Wash. 98052

[21] Appl. No.: 380,137

[22] Filed: Jul. 14, 1989

[51] Int. Cl.[5] ..... B62B 5/00

[52] U.S. Cl. ..... 280/79.3; 211/186; 312/297; 312/328; 312/350

[58] Field of Search ..... 280/79.3, 79.11, 79.2, 280/47.35, 47.34; 211/187, 186, 189, 188; 312/297, 350, 328

[56] References Cited

U.S. PATENT DOCUMENTS

| | | | |
|---|---|---|---|
| D. 227,964 | 7/1973 | Propst | 280/79.11 |
| 1,391,008 | 9/1921 | Richmond | 211/188 |
| 2,873,993 | 2/1959 | Savke | 280/79.2 |
| 3,008,788 | 11/1961 | Garner | 312/328 |
| 3,241,850 | 3/1966 | Propst | 280/47.35 |
| 3,573,879 | 4/1971 | Bergkamp | 280/47.35 |
| 3,868,123 | 2/1975 | Berg et al. | 280/79.2 |
| 4,351,541 | 9/1982 | Propst | 280/79.11 |
| 4,634,194 | 1/1987 | Svoboda | 312/297 |
| 4,696,522 | 9/1987 | Lowe | 312/297 |
| 4,743,040 | 5/1988 | Breveglieri et al. | 280/47.35 |
| 4,753,356 | 6/1988 | Nootenboom | 280/79.3 |

OTHER PUBLICATIONS

Brochure, pp. 2, 3, 20–24 of Herman Miller, publ. 1976.

*Primary Examiner*—David M. Mitchell
*Attorney, Agent, or Firm*—Seed and Berry

[57] ABSTRACT

A storage cart has top and bottom panel assemblies which are clamped against the ends of vertical end panels by draw rods extending through the end panels. Compression tubes are sleeved on the draw rods and are longitudinally compressed between the end panels. Bumper frames are provided which have horizontal portions through which the draw rods extend.

19 Claims, 8 Drawing Sheets

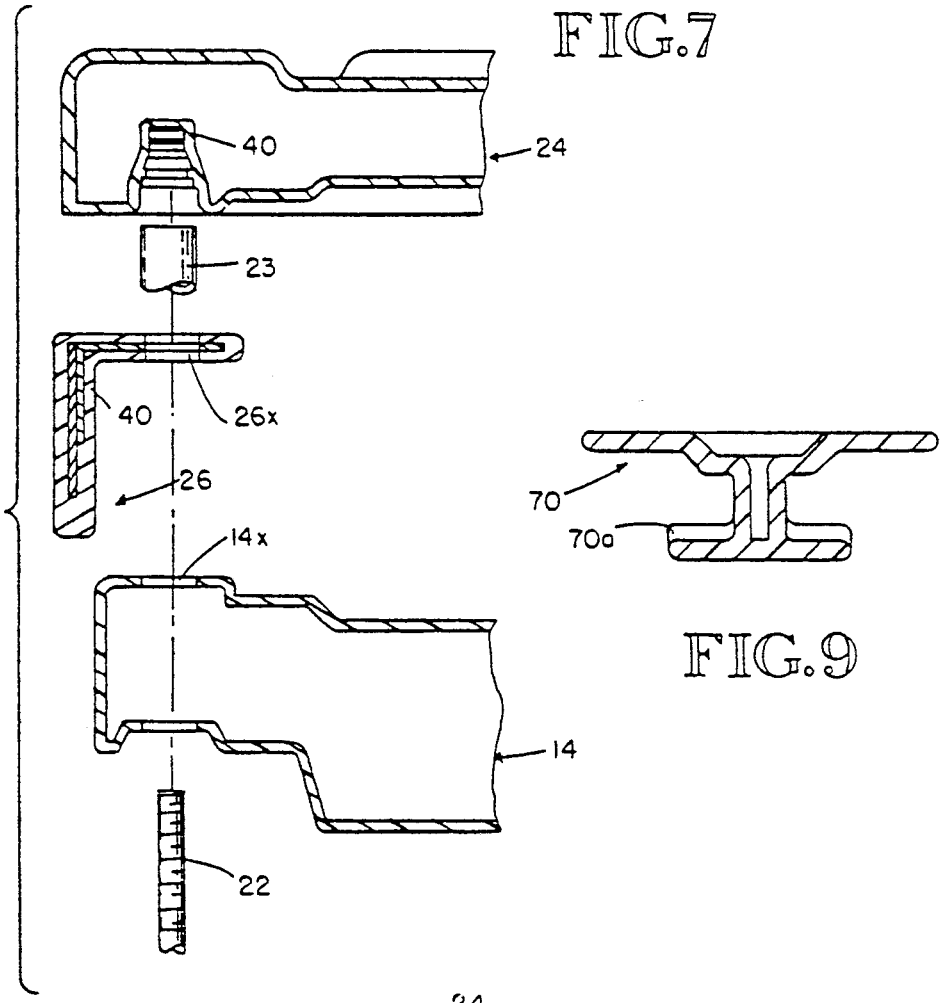
FIG. 7
FIG. 9
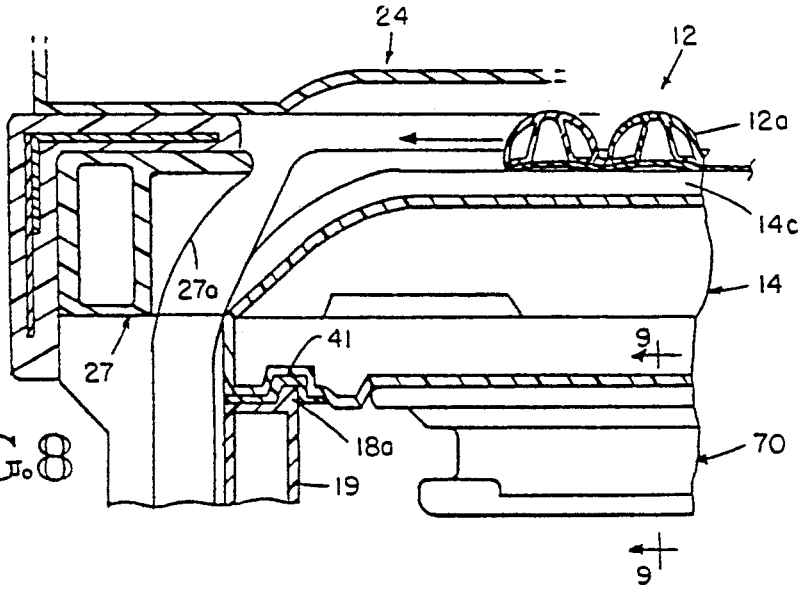
FIG. 8

CART ASSEMBLY

TECHNICAL FIELD

The present invention relates to vending and collection carts for use in material handling systems, such as, for example, the system for hotels and the like described in my copending application Ser. No. 237,155, filed Aug. 26, 1988, now abandoned in which the carts are adapted to receive various removable containers, shelves, and bins.

BACKGROUND OF THE INVENTION

There is a need for vending and collection carts for use in hotels by room attendants and food service personnel which are easy to use and maneuver, are readily cleanable and maintainable, are adapted to receive modular containers and shelves in a variety of arrangements, are easily assembled and reconfigured, have a furniture-grade appearance, and have excellent bumper protection against damage by accidental impact with walls or furniture.

SUMMARY OF THE INVENTION

In meeting the aforesaid needs, a cart structure is provided in which generally rectangular top and bottom panel assemblies are clamped against the top and bottom of end panels by draw rods which pass through spacer tubes. The draw rods extend from a tightening head upwardly through a bottom panel assembly and end panels to make a screw connection in nut inserts in the top panel assembly. The bottom panel assembly includes a rigid carriage frame to which caster wheel units are mounted. Tightening of the draw rods is limited by engagement of the ends of spacer tubes with the carriage frame and nut inserts. Preferably, the panel components of the cart are unitary, blow-molded parts filled with plastic foam.

In the vending version of the cart, the front can be closed by a tambour door which is vertically guided at the front and back of the cart by guideways in the end panels which continue downwardly from a horizontal passageway provided by the top panel assembly. The end panels and an optional removable center divider panel have horizontal slideways spaced apart a modular distance to receive support lips on removable containers, totes, and shelves. In the collection version of the cart, there is a swing-out removable bin and a top drawer.

Upper and lower horizontal bumper frames of resilient material are provided to protect against damage by accidental contact of the cart with other objects. These frames are clamped in position as parts of the top and bottom panel assemblies.

BRIEF DESCRIPTION OF THE DRAWINGS

FIG. 7 is an exploded, fragmentary sectional view of a top corner portion of the cart;

FIG. 8 is a transverse, fragmentary, vertical sectional view of a forward portion of the cart;

FIG. 9 is a detail, vertical sectional view taken as indicated by line 9—9 in FIG. 8;

DETAILED DESCRIPTION OF THE INVENTION

Figure 1:
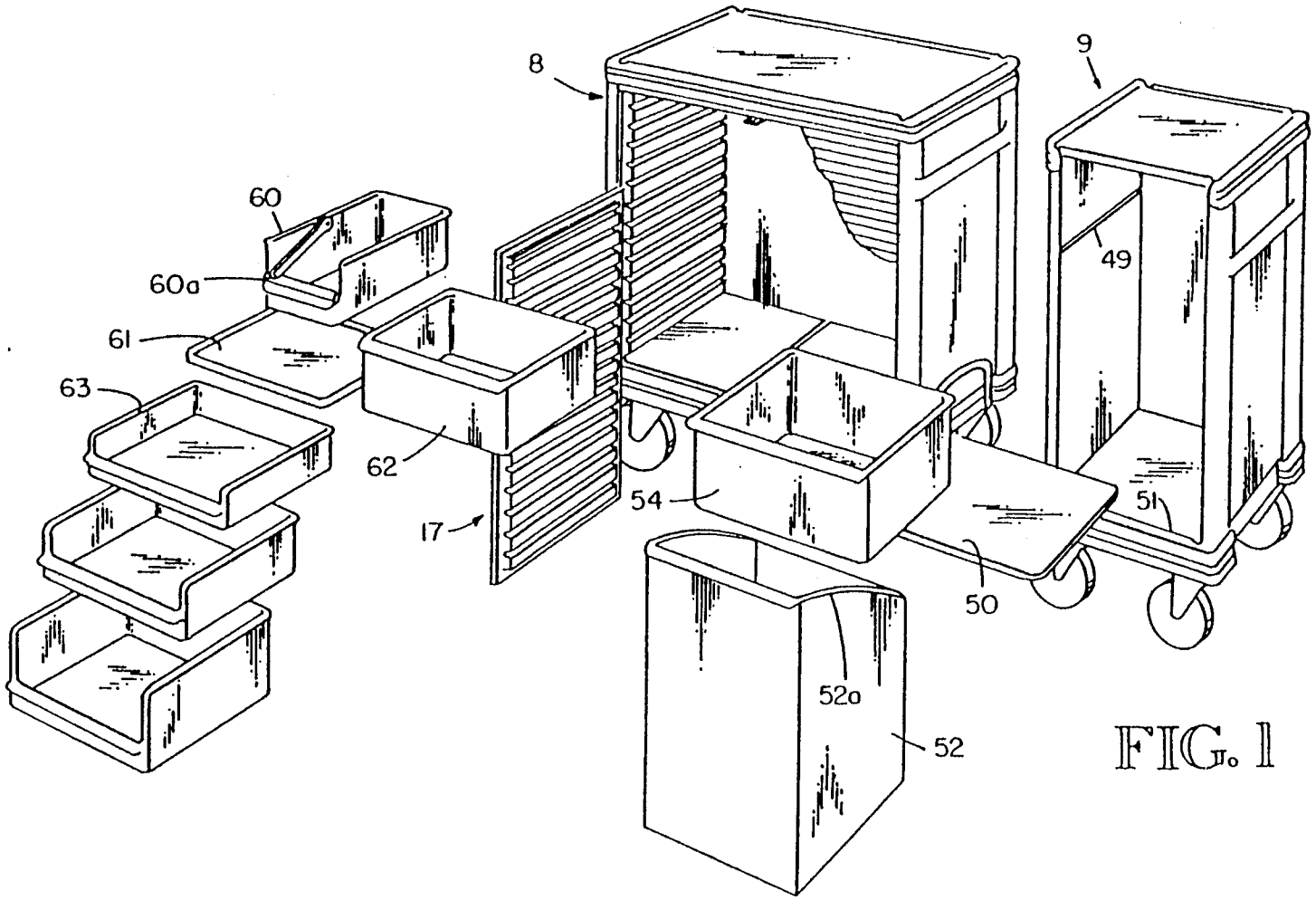
FIG. 1 is a perspective view illustrating vending and collection carts made in accordance with the present invention, and showing examples of various containers to be used therewith.
Figures 2, 3:
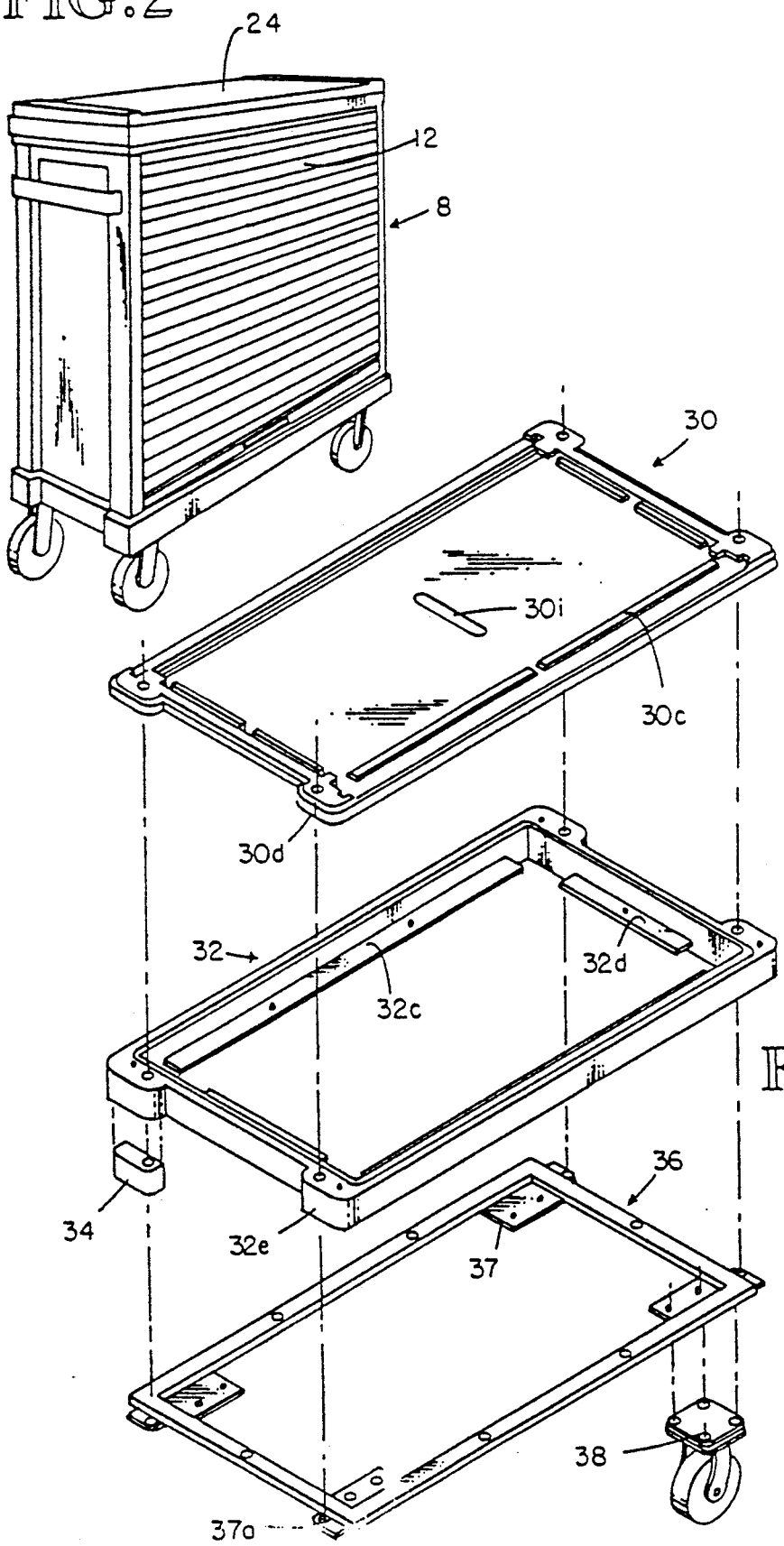
FIG. 2 is a perspective view of the vendor cart with the tambour door in closed position.
FIG. 3 is an exploded perspective view of the components of the bottom subassembly for the cart.
Figure 4:
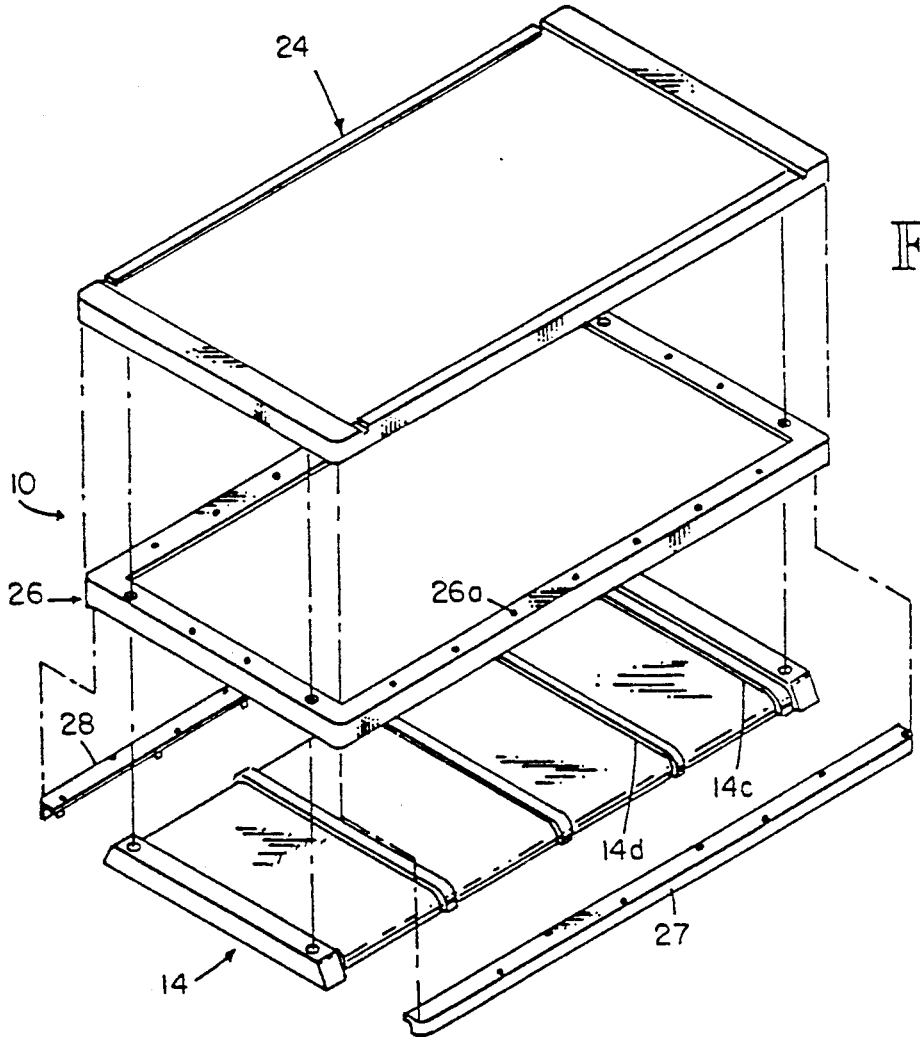
FIG. 4 is an exploded perspective view of the top components of the cart.
Figure 5:
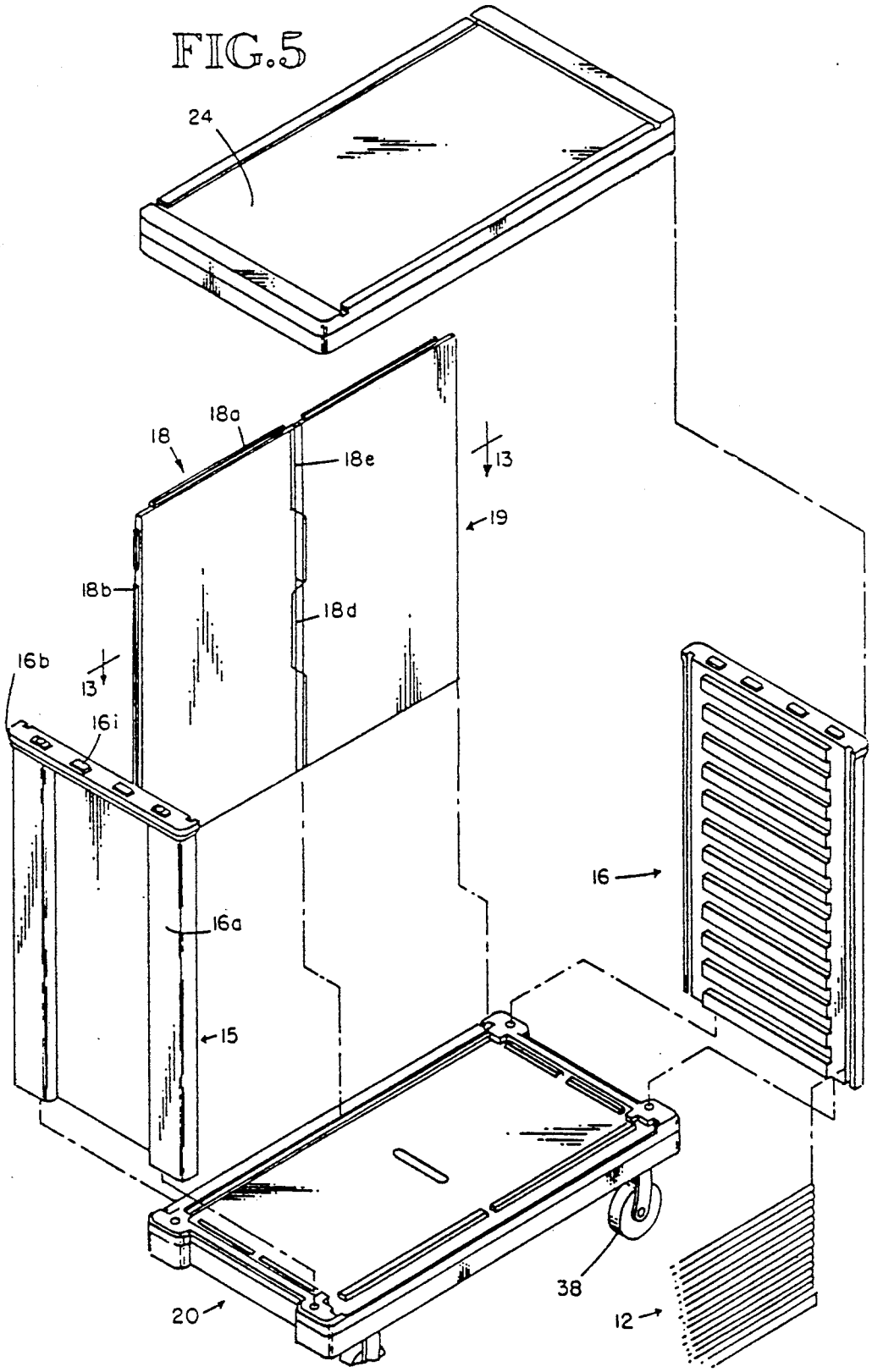
FIG. 5 is an exploded perspective view showing the top and bottom units assembled, and the end panels, back panels, inner top panel, and tambour door oriented for assembly.
Figure 6:
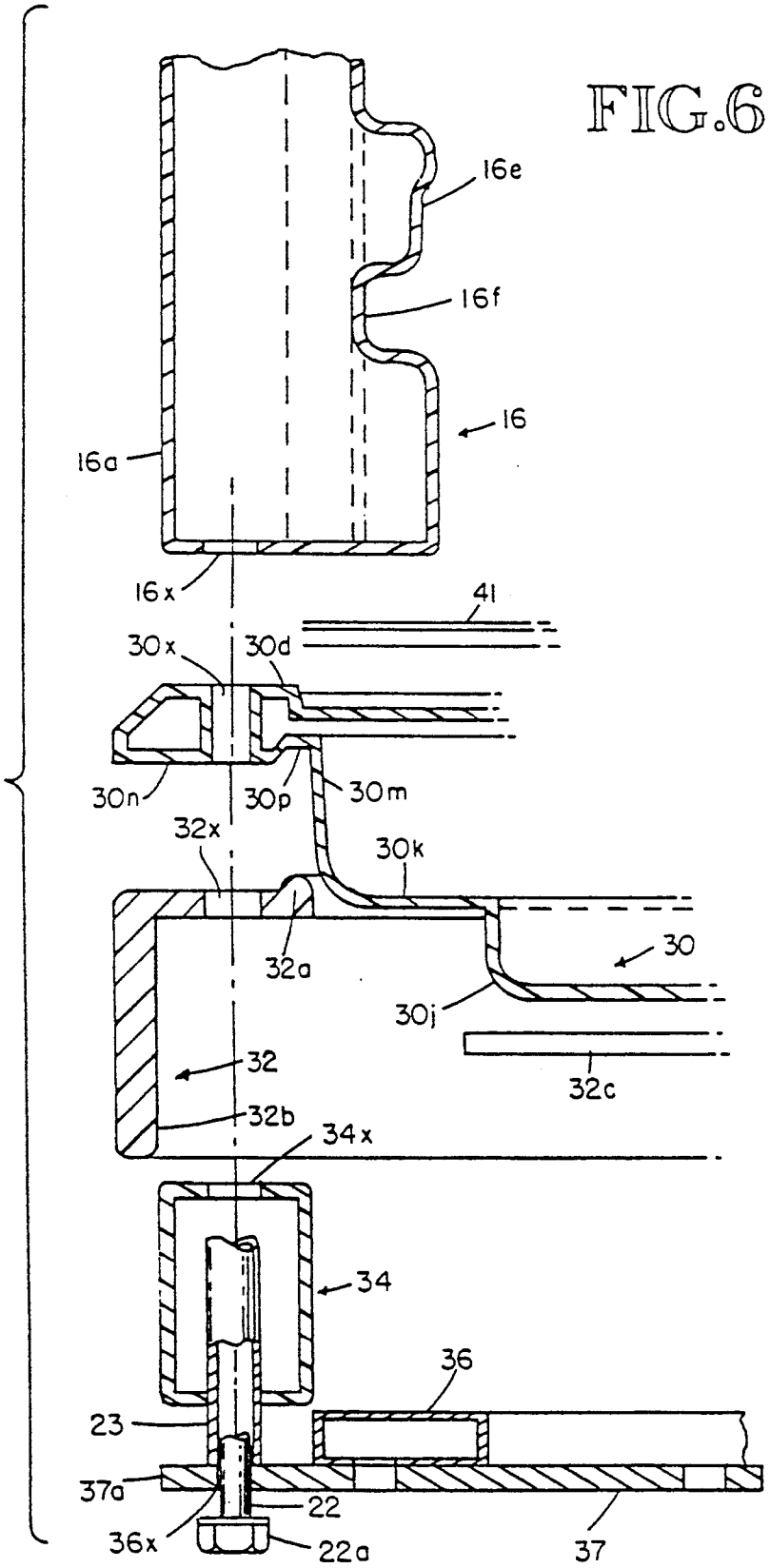
FIG. 6 is an exploded, fragmentary, vertical sectional view at a bottom corner portion of the cart.
Figure 10:
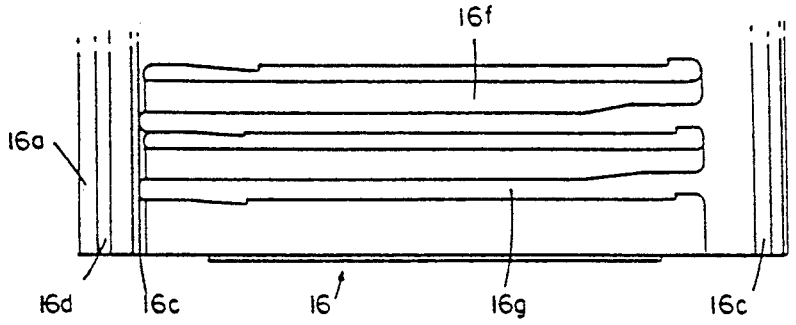
FIG. 10 is an elevational view of a bottom portion of one of the end panels as viewed from the inside of the cart.
Figure 11:
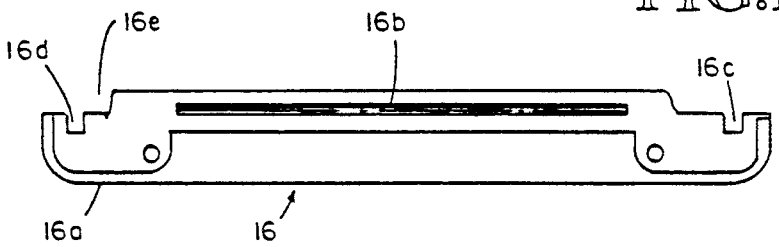
FIG. 11 is a bottom plan view of one of the end panels.
Figure 12:
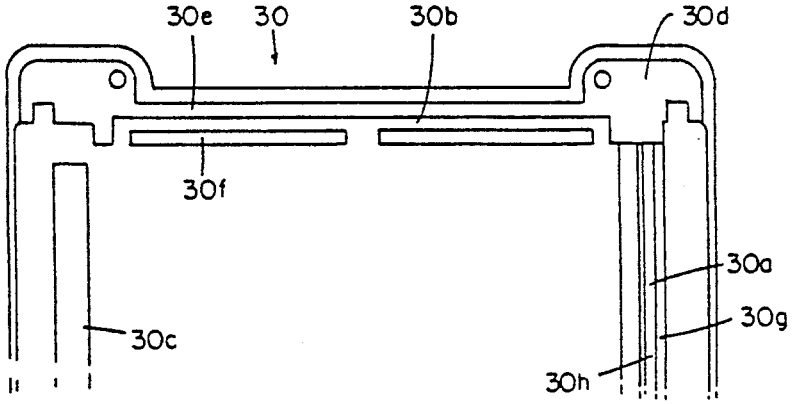
FIG. 12 is a fragmentary top plan view of the bottom panel.

Referring to the drawings, it is seen that a vendor cart 8 in accordance with the present invention has a top unit 10, tambour door 12, inner top panel 14, end panels 15–16, center divider panel 17, back panels 18–19, and bottom unit 20 which are clamped together by four vertical draw rods 22 passing through spacer tubes 23 adjacent the corners of the cart. The top unit 10 comprises an outer top panel 24, top bumper frame 26, and front and back guide rails 27–28; and the bottom unit 20 comprises a bottom panel 30, bottom bumper frame 32, four corner inserts 34, and a carriage having a frame 36 and four caster wheel units 38.

Directing attention to the bottom panel 30, the upper side thereof is formed with a back longitudinal groove **30*a*, end grooves 30*b*, and a front longitudinal raised curb 30*c* having a central cutout. The back and end grooves 30*a*, 30*b* terminate at front and back raised wall portions 30*d* at the top of rounded corner extensions. These raised wall portions 30*d* are connected by end curbs 30*e*, which, together with end 30*a* is defined by a back ridge 30*g* and a sloped ridge 30*h* at the front. A central keyway slot 30*i* extends partway across the width of the bottom panel. On its underside, the bottom panel 30 has a rectangular depending central section 30*j* surrounded at the top by a continuous downward facing wall 30*k*. This wall 30*k* merges with an outer wall 30*m*, at the top of which there is a border flange 30*n* presenting a downwardly facing circumferential groove 30*p***.

The bottom bumper 32 is a molded, resilient, urethane part shaped to contour to the periphery of the bottom panel 30 and having an upper rib **32*a* formed to fit into the groove 30*p* of the bottom panel. This upper rib 32*a* is inset from a vertical bumper wall 32*b* such that the outer face of the bumper wall is spaced outwardly slightly with respect to the periphery of the bottom panel 30. Projecting inwardly from the vertical bumper wall 30*b* are front and back flanges 32*c* and end flanges 32*d* resting on the carriage frame 36. These flanges 32*c*, 32*d* and the vertical wall 32*b* preferably have perforated metal inserts 40 for stiffening. At the corners, the bottom bumper 32 has contoured extensions 32*e* which match the corner extensions 30*d* of the bottom panel 30. The corner inserts 34** fit into the underside of the end extensions 32*e* of the bottom bumper 32 as backing for the corners thereof.

The carriage frame 36 is generally rectangular and surrounds the central depending section 30*j* of the bottom panel. Corner mounting plates 37 are fixed on the underside of the carriage frame for receiving the caster wheel units 38. Screws secure the bumper flanges 32*c*–32*d*, corner inserts 34, and carriage frame 36 to the bottom panel 30. Preferably, the bottom panel is molded with nut inserts for the screws. The corner mounting plates 37 have extension portions 37*a* projecting outwardly from the carriage frame 37 to underlie the corner inserts 34.

The end panels 15, 16 are formed with integral corner columns 16*a* which surmount the corner extensions of the bottom panel 30 and have bottom tongues 16*b* 30. The inner faces of the column portions 16*a* of the end panels are formed with front and back door guiding channels 16*c*, 16*d* and back locking grooves 16*e*. Inwardly of these locking grooves are a series of horizontal support ribs 16*f* shaped to provide a series of guideways 16*g*. Each of these guideways 16*g* is formed at its front entry end with a front bottom stop and a complementing upper expanded accessway which tapers downwardly at the rear to merge with the remainder of the top wall of the guideways. At their upper end, the end panels are widened by a top rib 16*h* which is preferably formed with a series of upwardly projecting dowels 16*i* at its upper face.

The back panels 18, 19 each have top and bottom lips 18*a* for interfitting with the inner top panel 14 and the back groove 30*a* in the bottom panel. They also have end tabs 18*c* for fitting into the back locking grooves 16*e* of the end panels 15, 16. At their opposed edges, each back panel is formed with a central trapezoidal shaped extension 18*d* and an end extension 18*e*. These extensions are staggered and shaped so that the central extension of each back panel fits between the end extension and central extension of the other back panel. Furthermore, the front face of each extension has a longitudinal retaining groove 18*f*, and the back face of each extension 18*d*, 18*e* is recessed through half of its thickness so that the extension has a front lip portion 18*g* and the lip portions of the extensions overlap complementing recesses formed along the front faces of the back panels between the extensions. With this arrangement, the back panels collectively provide a forwardly facing retaining groove by way of the retaining grooves 18*f* in the extensions.

The underside of the inner top panel 14 is provided near its ends with recessed, tapered seats 14*a* to receive the dowels 16*i* at the top of the end panels and has a rear longitudinal groove 14*b* to receive the lips 18*a* at the upper end of the back panels 18, 19. The top of the inner panel is formed with end guides 14*c* and three raised complementing central guides 14*d* for guiding the tambour door 12. The guides project forwardly at the front ends of the inner top panel as guide extensions. These extensions are complemented by overlying guides 27*a* presented on the underside of the front and back guide rails 27, 28.

Referring to the top subassembly 10, the upper bumper frame 26 has an angle cross section providing a horizontal, inturned anchoring flange 26*a* and an outer vertical bumper flange 26*b*. The guide rails 27–28 also have an angle shape in cross section and are adapted to fit within the confines of the front and back sections of the bumper frame 26. Screws anchor the upper bumper frame 26 and guide rails 27–28 to the top panel 14.

The tambour door 12 comprises slat members 12*a* which are generally semicircular in cross-section to provide a rounded outer face and a flat back face. The back faces of the slats are bonded by a suitable adhesive to a flexible, durable fabric backing sheet, such as Mylar.

The central divider panel 17 has guideways on its opposite sides matching the guideways 16*g* on the end panels. It also has top and bottom integral keys 17*a*, 17*b* and rear lips 17*c*.

In assembling the cart, the outer top panel 24, top bumper frame 26, and front and back guide rails 27–28 are connected together as a top unit 10 by screws passing through the guide rails and the anchoring flange 26*a* of the top bumper frame into nut inserts molded into the outer top panel 24. Similarly, the bottom panel 30, bottom bumper frame 32, corner inserts 34, and carriage frame 36 with the caster wheel units 38 bolted thereto are screw-connected together by screws passing through the carriage frame and the bottom bumper flanges 32*c*, 32*d* into nut inserts molded into the bottom panel 30.

After resilient gasket strips 41, 42 are inserted in the back grooves on the underside of the inner top panel 14 and the upper side of the bottom panel 30, the back panels are interfitted and positioned on the bottom gasket strip 42, with the bottom panel lips fitting into the groove along the gasket strip. The end panels 15, 16 are then interfitted with the end lips 18*c* on the back panels and seated on the bottom panel 30. The four spacer tubes 23 can then be passed downwardly through registering openings 16*x*, 30*x*, 32*x* and 34*x* in the end panels, bottom panel 30, bottom bumper frame 32, and corner inserts 34 into engagement with the top face of the carriage frame 36 above smaller openings 36*x* in carriage frame extension 37*a*. When this is accomplished, the upper ends of the tubes 23 will project above the upper ends of the end panels 15, 16. The inner top panel 14 is then lowered by use of holes 14*x* over the upwardly projecting portions of the tubes 23 into interfitting engagement with the upper ends of the end panels 15, 16. The tambour door 12 is then placed on the inner top panel, with front and back portions of the door fitting into the front and back door guideways 16*c*, 16*d* presented by the end panels 15, 16. The top unit 10 is then lowered into position on the remaining upwardly projecting portions of the tubes 23 by use of the holes 26*x* in the top bumper frame 26. If the center divider panel 17 is to be used, it is positioned with its bottom key 17*a* fitting into the slot 30*i* in the bottom panel 30 and its rear lips 17*c* fitting into the back central groove 18*f* presented by back panels before the inner top panel is brought into position and interfits with the top key 17*b*. As a final step, the draw rods 22 are passed upwardly through the holes 36*x* in the carriage frame extension 37*a* registering with the tubes 23 and are pushed through the tubes to the nut inserts 40 in the outer top panel 24, whereupon the draw rods 22 are threaded into the inserts 40 by application of a wrench to the hexagonal heads 22*a* on the lower ends of the rods until these heads bear tightly against the underface of the carriage frame extension 37*a*. Overtensioning of the draw rods is prevented by having the length of the tubes 23 such that the ends of the tubes bear against the nut inserts and the top face of the carriage frame before the flange 26*a* of the upper bumper 26 and the flanges 32*c*, 32*d* of the bottom bumper 32 have been more than slightly compressed. Such compression is advantageous to keep tight engagement of the cart components. Handles 43 may be screw-mounted on the end panels 15–16 at the conclusion of the cart assembly or before mounting the end panels.

Figure 14:
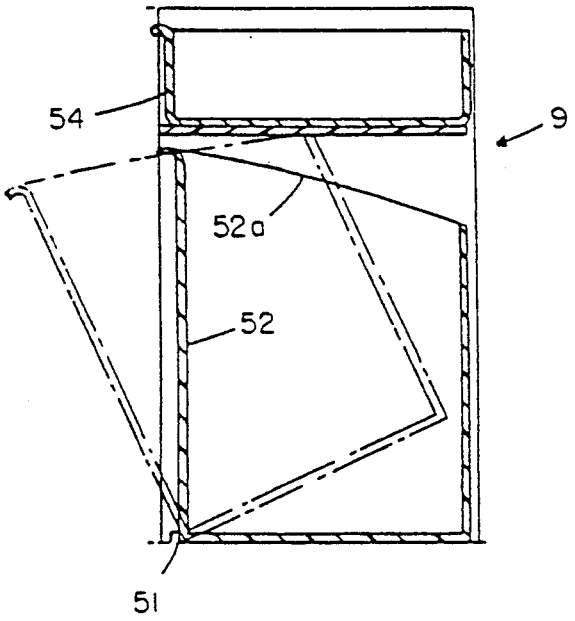
Figure 13:
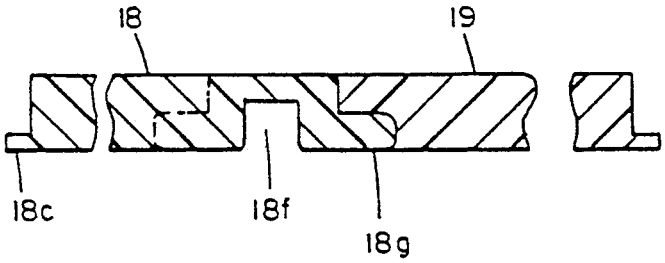
FIG. 13 is a detail, fragmentary, horizontal sectional view of the back panels taken as indicated by line 13—13 in FIG. 5.

Directing attention to FIGS. 1 and 14, a collection cart 9 may be constructed in the same manner as the vendor cart 8, with a smaller bottom assembly 10, without an inner top panel 14, and with a one-piece back panel. The end panels are grooved on their inside face at 49 to receive a shelf 50, and the bottom panel is provided with a front stop strip 51. A swing-out bin 52 rests on the bottom panel and has a curved upward edge 52*a* on its side walls which is of a curvature to engage the underside of the shelf 50 as a stop when the bin is in open position. When the bin is slightly open, it can be lifted over the stop strip 51 for removal of the bin. A top drawer 54 is provided which rests on the shelf 50.

As indicated in FIG. 1, the vendor cart may be used with a variety of removable container components in the form of totes 60 with swing-up handles 60*a*, shelves or trays 61, drawers 62, or dispensing drawers 63 with a lowered front wall for easy access. The totes and drawers preferably have a front downwardly curved lip to function as a handle and border lips to engage the support ribs 16*f* on the end panels 16. When totes 60 narrower than the width between the end panels 16 and center divider panel 17 are to be used, auxiliary supports 70 may be screw-mounted on the underside of the inner top panel 14. These auxiliary supports present support flanges 70*a* opposite the upper support ribs 16*f* on the end panels.

It will be appreciated that, although specific embodiments of the invention have been described herein for purposes of illustration, various modifications may be made without departing from the spirit and scope of the invention. Accordingly, the invention is not limited except as by the appended claims.

I claim:

1. A cart comprising:

a generally rectangular bottom panel assembly having bottom wheel mounts adjacent its corners;

a generally rectangular top panel assembly spaced above said bottom panel assembly and including a plastic top panel with nut inserts fixed therein against rotation;

said top and bottom panel assemblies including respective bumper frames having outwardly exposed bumper faces and having horizontal portions;

vertical end panels extending between said top and bottom panel assemblies; and draw rod means extending vertically through the entire vertical length of said end panels and through said horizontal portions of said bumper frames, said draw rod means threadably engaging said nut inserts and engaging the bottom of said bottom panel assembly for clamping said top panel assembly and base panel assembly against the upper and lower ends, respectively, of said end panels.

2. A cart according to claim 1 in which said top and bottom panel assemblies each have a tongue-and-groove interfit with said end panels.

3. A cart according to claim 1 in which said draw rod means comprises four rods threaded into said nut inserts and each having an enlarged head bearing against the underside of said bottom panel assembly.

4. A cart according to claim 3 in which spacer tubes surround said rods, said tubes engaging said nut inserts at their upper end and bearing against said bottom panel assembly at their lower end so as to be subjected to compressive forces when said rods are tightened by being turned in said nut inserts to the extent that said top and bottom panel assemblies firmly engage the upper and lower ends of said end panels.

5. A cart according to claim 1 in which said bottom panel assembly has a bottom rigid carriage frame providing said wheel mounts, and said draw rod means comprises draw rods each having an enlarged bottom head bearing against the underside of said carriage frame, said draw rods each being threaded at its upper end into said nut inserts.

6. A cart according to claim 5 in which longitudinally compressed tubes surround said draw rods and are longer than said end panels, said tubes engaging the upper side of said carriage frame at their lower end and engaging said top panel assembly at their upper end.

7. A cart according to claim 6 in which said compressed tubes engage said nut inserts at their upper end and said nut inserts are recessed in said top panel.

8. A cart comprising:

a generally rectangular bottom panel assembly including a bottom panel, a resilient bottom bumper frame below said bottom panel, and a rigid bottom carriage frame beneath said bumper frame and having bottom wheel mounts adjacent its corners, said bumper frame having outwardly exposed bumper faces a generally rectangular top panel assembly spaced above said bottom panel assembly;

vertical end panels extending between said top and bottom panel assemblies;

draw rod means extending vertically through the entire vertical length of said end panels and engaging said top panel assembly and bottom carriage frame for clamping said top panel assembly and bottom panel assembly against the upper and lower ends, respectively, of said end panels and for clamping said bottom bumper frame between said bottom panel and carriage frame.

9. A cart according to claim 8 in which said carriage frame surrounds a general rectangular open area, and said bottom panel has a central portion depending into said open area and has an outer border portion overlying said carriage frame, said bumper frame having horizontal parts clamped between said border portion and said carriage frame.

10. A cart according to claim 8 in which said bumper frame has corner inserts overlying said carriage frame, and said draw rod means passes through said corner inserts.

11. A cart according to claim 8 in which said top panel assembly includes a resilient top bumper frame.

12. A cart according to claim 11 in which said top bumper frame has horizontal parts through which said rod means extends.

13. A cart according to claim 8 in which said top panel assembly includes a top panel into which said draw rod means is anchored, and has a top bumper frame with horizontal parts clamped against the underside of said top panel.

14. A cart according to claim 8 in which said bumper frame is made from a resilient material.

15. A cart comprising:

a generally rectangular bottom panel assembly having bottom wheel mounts adjacent its corners;

a generally rectangular top panel assembly spaced above said base panel assembly;

vertical end panels extending between said top and bottom panel assemblies; and draw rod means extending vertically through the entire vertical length of said end panels and engaging said top and bottom panel assemblies for clamping said top panel assembly and base panel assembly against the upper and lower ends, respectively, of said end panels;

and compression tubes sleeved on said draw rod means and extending with said draw rod means through said end panels into engagement with said panel assemblies, said compression tubes being longer than said end panels so that the compression tubes are longitudinally compressed responsive to clamping of said panel assemblies against the ends of said end panels by said draw rod means.

16. A cart comprising;

a generally rectangular bottom panel assembly having bottom wheel mounts adjacent its corners;

a generally rectangular top panel assembly spaced above said base panel assembly;

vertical end panels extending between said top and bottom panel assemblies; and draw rod means extending vertically through the entire vertical length of said end panels and engaging said top and bottom panel assemblies for clamping said top panel assembly and base panel assembly against the upper and lower ends, respectively, of said end panels;

one of said panel assemblies including resilient means vertically spaced from a respective one of said ends of said end panels and compressed within said panel assembly responsive to said clamping.

17. A cart according to claim 16 in which both of said panel assemblies include respective resilient means compressed responsive to said clamping.

18. A cart according to claim 16 in which said resilient means is a horizontal portion of top and bottom resilient bumper frames having outwardly exposed bumper faces.

19. A cart comprising;

a generally rectangular bottom panel assembly having bottom wheel mounts adjacent its corners;

a generally rectangular top panel assembly spaced above said base panel assembly;

vertical end panels extending between said top and bottom panel assemblies; and draw rod means extending vertically through the entire vertical length of said end panels and engaging said top and bottom panel assemblies for clamping said top panel assembly and base panel assembly against the upper and lower ends, respectively, of said end panels;

one of said panel assemblies including resilient means compressed responsive to said clamping, said resilient means including horizontal portions of a bumper frame having outwardly exposed bumper faces.

* * * * *